US005873176A

United States Patent [19]

Richards

[11] Patent Number: 5,873,176

[45] Date of Patent: Feb. 23, 1999

[54] ADAPTOR FOR CLEANING SMALL PAINT ROLLERS

[76] Inventor: Jeffrey Richards, 114 Fowling St., Playa Del Rey, Calif. 90293

[21] Appl. No.: 705,304

[22] Filed: Aug. 29, 1996

[51] Int. Cl.[6] ..... F26B 17/24

[52] U.S. Cl. ..... 34/58; 34/97; 134/138; 134/196

[58] Field of Search ..... 34/58, 312, 97, 34/98; 134/138, 140, 33, 38, 196, 149; 74/127

[56] References Cited

U.S. PATENT DOCUMENTS

| | | | |
|---|---|---|---|
| 2,794,265 | 6/1957 | Kruger | 34/58 |
| 2,830,383 | 4/1958 | Weil | 34/58 |
| 2,884,709 | 5/1959 | Kruger | 34/58 |
| 5,588,221 | 12/1996 | Hoeltke et al. | 34/58 |
| 5,630,284 | 5/1997 | Huang | 34/58 |

*Primary Examiner*—Henry A. Bennett
*Assistant Examiner*—Pamela A. Wilson
*Attorney, Agent, or Firm*—Lane, Aitken & McCann

[57] ABSTRACT

An adaptor for holding paint rollers of smaller than standard size has a spindle, resilient elongate elements for clamping the roller on the spindle, a stem sized to be releasably retained on a spinning device, and a stop element for setting the position of the adaptor on the spinning device.

16 Claims, 3 Drawing Sheets

ADAPTOR FOR CLEANING SMALL PAINT ROLLERS

BACKGROUND OF THE INVENTION

The present invention relates to apparatus for cleaning paint rollers and, more specifically, to an adaptor for holding a paint roller cover which is smaller than standard so that the cover can be mounted on conventional devices designed to spin and clean paint roller covers of standard size.

There are conventional devices for holding and spinning paint roller covers of standard size and paint brushes for the purpose of cleaning the covers and brushes. Typically, a standard paint roller cover fits over and is retained by fingers of spring steel, while the fingers and the cover are spun. A drawback of such conventional spinners is that they are unable to hold paint roller covers of other than standard size. Paint roller covers having a diameter smaller than standard are popular for many applications. They are known by various names, such as "wienie, hot dog, slim Jim", etc. In the absence of a suitable spinner for cleaning the small rollers, the rollers are either cleaned by inefficient, time-consuming methods or simply thrown away.

SUMMARY OF THE INVENTION

By the present invention, an adaptor is provided which is mountable on conventional paint roller and brush spinners and is capable of releasably holding paint rollers of smaller than standard size. A conventional paint roller and brush spinner typically has a first pair of elongate cantilevered spring fingers sized to resiliently engage the interior surface of a standard paint roller cover such that the spring fingers frictionally resiliently engage the interior surface of the cover and hold the cover in place while the fingers and cover are spun. Conventional spinners also typically include a second pair of resilient spring fingers positioned within the first pair of spring fingers and spaced from one another so as to resiliently engage side surfaces of a paint brush handle, whereby a paint brush can also be held and spun for cleaning. The spring fingers of the first set can each include an inwardly directed flange to engage the sides of the paint brush handle for greater holding stability.

The adaptor of the present invention comprises a spindle for insertion through the bore of a small roller and a resilient retainer for resiliently engaging and holding the exterior of the small roller when the roller is in position on the spindle. The adaptor includes a stem projecting in a direction opposite to the direction of projection of the spindle, the stem being sized to be frictionally retained by the spring fingers of a conventional roller and brush spinner. More specifically, the sides of the stem of the adaptor are frictionally retained by engagement with the second pair of spring fingers, and the top and bottom of the stem are frictionally retained by the inwardly directed flanges on the first set of spring fingers. The spindle and the stem are generally colinear, meeting at a point from which a stop depends. The stop contacts the end of one of the spring fingers of the first pair to limit the movement of the adaptor into both pairs of spring fingers.

The lengths of the spindle and the spring fingers are such that wienie rollers of various lengths are releasably securable on the adaptor. Wienie rollers each have a longitudinal bore open at one end and closed at the opposite end. Wienie rollers typically have lengths of from two inches to nine inches, and the lengths of the spindle and spring fingers of the adaptor are chosen so that wienie rollers of all typical lengths can be received and held on the adapter. For this purpose, points of engagement between the spring fingers and the exterior of a wienie roller are spaced from the end of the spindle by a distance no greater than the axial length of the smallest wienie roller to be held. The spring fingers diverge from the spindle near their ends to guide the end of the wienie roller onto the spindle and to permit the wienie roller to move between the spring fingers, deflecting the fingers outwardly.

DETAILED DESCRIPTION OF THE PREFERRED EMBODIMENT

Figure 1:
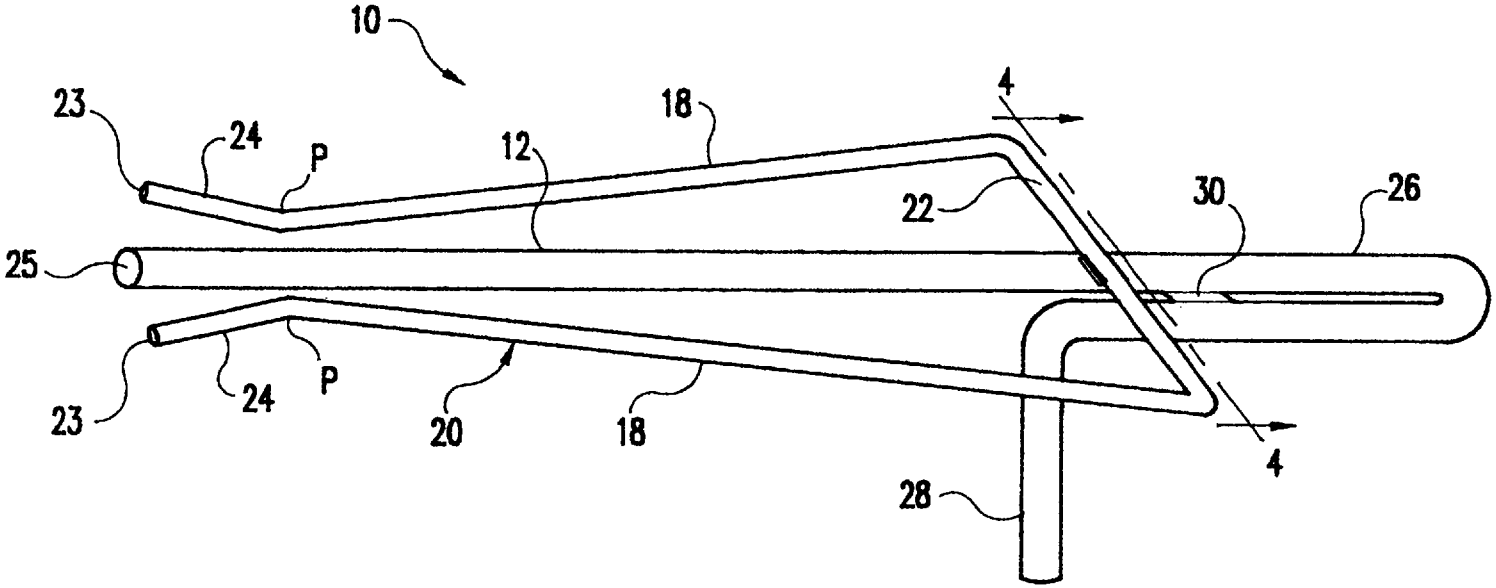
FIG. 1 is a perspective view of the adaptor according to the present invention for holding a wienie roller on a spinner.
Figure 2:
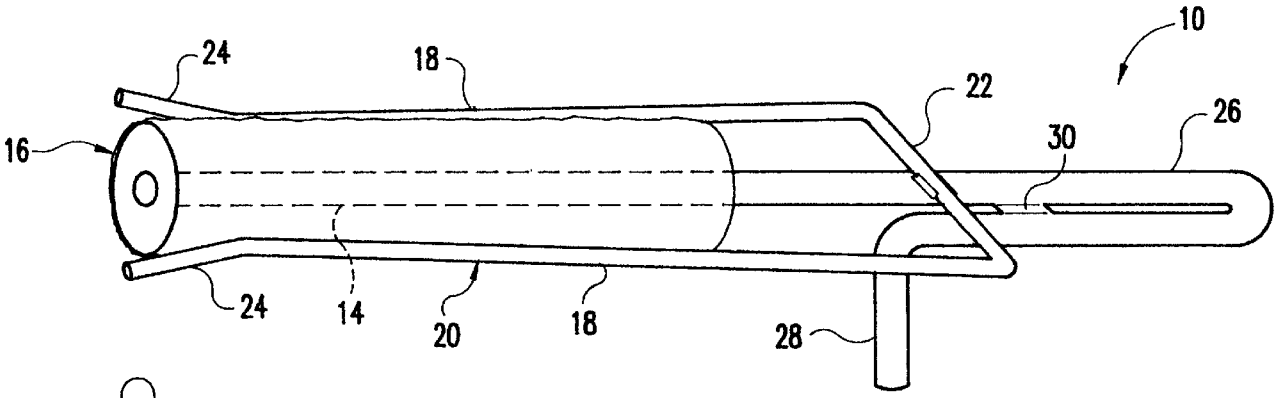
FIG. 2 is a perspective view of the adaptor of FIG. 1 holding a wienie roller.

As can be seen from FIGS. 1 and 2, the adaptor according to the present invention, which is designated generally by the reference numeral 10, includes an elongate spindle 12 for receiving a bore 14 of a wienie roller 16 or other tubular applicator. Elongate resilient elements 18 are connected to the spindle 12 for releasably retaining the applicator 16 on the spindle. The elongate elements 18 are resiliently biased toward the spindle 12 to engage outer surfaces of the wienie roller 16, which is interposed between the elongate elements 18 and the spindle 12, to clamp the wienie roller onto the spindle. In the illustrated embodiment, the spindle 12 comprises a steel rod or wire, and the elongate elements 18 are part of a member 20 of spring steel, or other resilient material, which has a transverse portion 22 welded to the spindle 12, with the elongate elements 18 turned at angles to the transverse portion 22 and extending generally parallel to the spindle 12. Each elongate element 18 has a free end 23 distal to the transverse portion 22 and adjacent to a free end of the spindle 12. Each elongate element 18 has a guide portion 24 projecting away from the spindle 12 at an oblique angle from a point P adjacent to but spaced slightly from an unattached end 25 of the spindle.

The bores of wienie rollers are open at one end and closed at the opposite end. As a result, the closed end of the bore 14 engages the unattached end 25 of the spindle 12 and prevents further movement of the wienie roller 16 onto the adaptor 10. Wienie rollers are typically available in lengths from a minimum of two inches to a maximum of nine inches. The spindle 12 has a length at least as great as the length of the longest wienie rollers, so that the adaptor 10 can receive wienie rollers of any length. Furthermore, the axial distance from the unattached end of the spindle 12 to the point at which the elongate elements 18 turn outward at an oblique angle is less than the axial length of the shortest available wienie rollers. Thus, even the shortest wienie rollers are securely held in place on the spindle 12 by the elongate elements 18. In view of the wienie rollers currently available, the spindle 12 is about nine inches long, and the distance from the unattached end of the spindle 12 to the point at which the guide portions 24 turn outwardly from the spindle is less than two inches.

A stem 26 is connected to the spindle 12, extending from the transverse portion 22 of the element 20 in a direction opposite from the direction in which the spindle 12 extends, generally colinear with the spindle 12. The stem 26 is sized and shaped to be received and releasably retained in a conventional paint roller and brush spinner. A stop element 28 extends from the region of the juncture of the spindle 12, the transverse portion 22, and the stem 26 in a direction which is perpendicular to the directions of extension of the spindle 12 and transverse portion 22. In the illustrated embodiment, the stem 26 is a portion of the steel rod or wire which defines the spindle 12. The portion of the wire in the spindle 26 has a length of about three inches and is turned back in a 180° hairpin turn to extend back to the transverse portion 22. The parallel portions of the stem 26 can be welded together by a weld 30, and the transverse portion 22 can be secured to the rod or wire defining both the spindle 12 and the stem 26 by welding. Also in the illustrated embodiment, the stop element 28 is a portion of the rod or wire defining the spindle 12 and the stem 26, the stop element 28 being defined by a terminal portion which is turned downward from the stem 26 near the juncture of the stem with the transverse portion 22.

Figure 4:
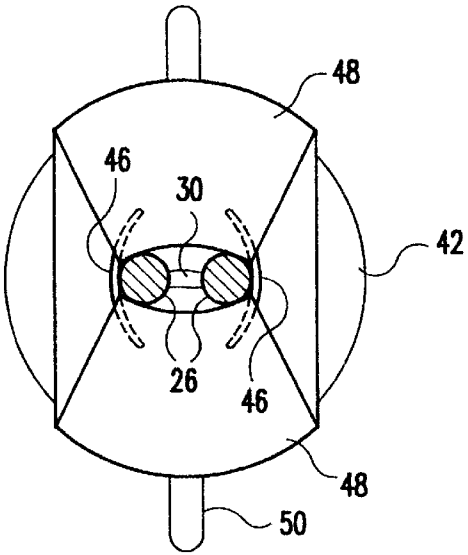
FIG. 4 is a left end view of the spinner of FIG. 3, showing the adaptor in cross section taken along the line 4—4 in FIG. 1.
Figure 3:
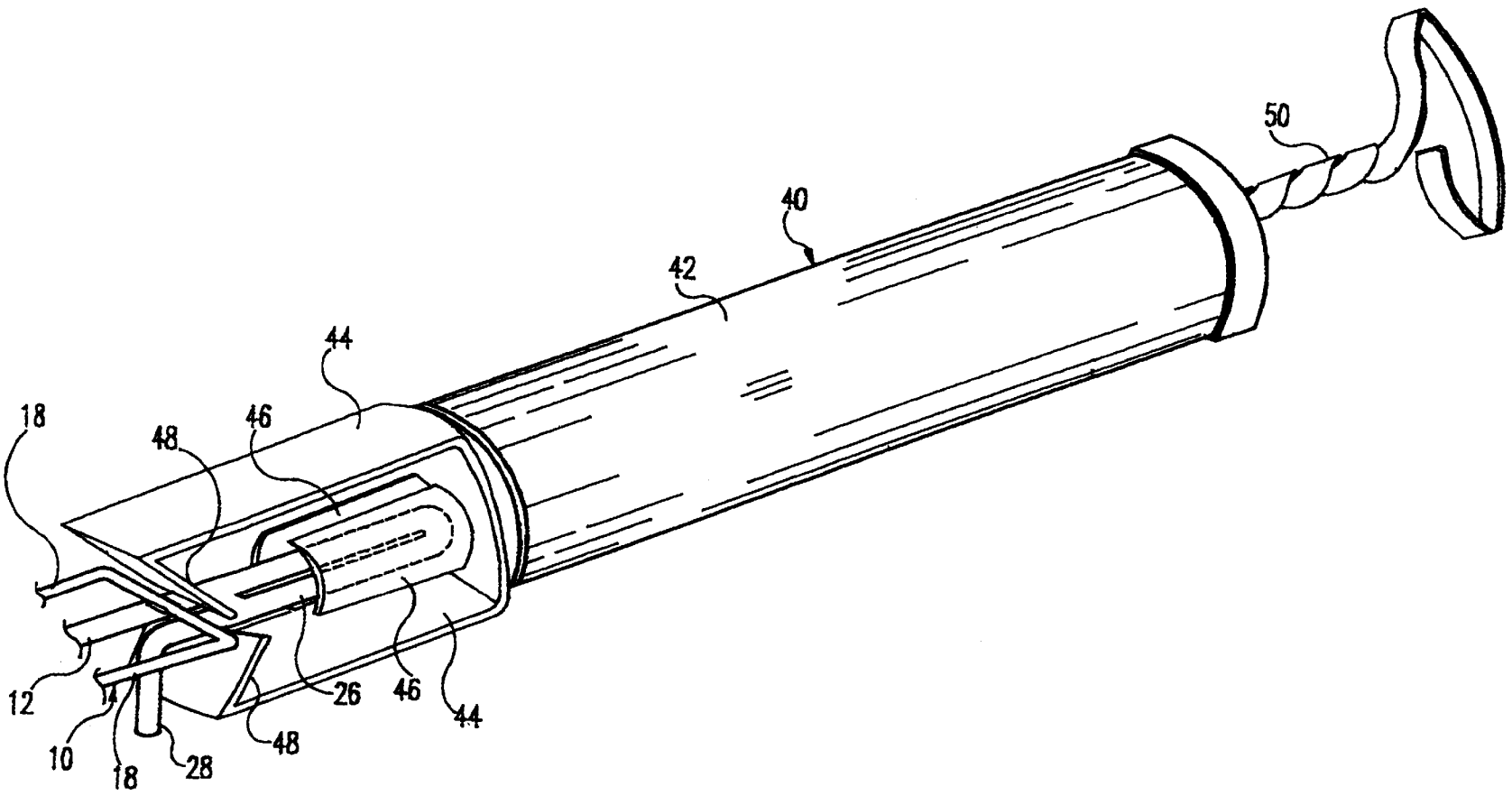
FIG. 3 is a perspective view of a portion of the adaptor of FIG. 1 releasably secured in a spinner.

As can be appreciated from FIGS. 3 and 4, the adaptor 10 is received in a conventional paint roller and brush spinner 40. The spinner 40 includes a cylindrical body 42, a first pair of spring fingers 44 mounted for rotation relative to the body 42, a second pair of spring fingers 46 mounted for rotation with the spring fingers 44, and a mechanism 50 for rotating the spring fingers 44 and 46.

The first pair of spring fingers 44 are sized and shaped to retain a standard paint roller cover by being biased by their inherent resilience radially outward against the inner surface of a roller cover of standard size. The second spring fingers 46, which are arranged within and concentric with the spring fingers 44, are sized and spaced to clamp the handle of a paint brush between them.

The stem 26 of the adaptor 10 has a width such that the spring fingers 46 resiliently and releasably retain the stem 26. Inwardly directed flanges 48 on the spring fingers 44 engage upper and lower surfaces of the stem 26, thereby resiliently and releasably retaining the stem. Accordingly, there are two areas of resilient engagement between the stem 26 and the spring fingers of the spinner 40, the areas being spaced from one another along the length of the stem to provide greater stability. The stop element 28 engages an end of one of the spring fingers 44 and, thereby, sets the position of the adaptor 10 in a particular spot relative to the spinning device 40.

I claim:

1. An adaptor for holding a tubular applicator on a spinning device, the tubular applicator having a bore comprising:

an elongate spindle for receiving the bore of the applicator;

means connected to said spindle for releasably retaining the applicator on the spindle, said retaining means comprising an element and means for resiliently biasing said element toward said spindle; and means for attaching said adaptor to the spinning device.

2. The adaptor of claim 1, wherein said element is an elongate element, and said means for resiliently biasing comprises the resilience of the material of the elongate element.

3. The adaptor of claim 2, wherein said elongate element has a free end, and a portion of said elongate element distal to said free end is secured relative to said spindle.

4. The adaptor of claim 3, wherein a guide portion of said elongate element projects away from said spindle at an oblique angle from a point adjacent said free end.

5. The adaptor of claim 4, wherein said adaptor is adapted to hold any of a plurality of tubular applications having various axial lengths, wherein said spindle has a length at least as great as the axial length of the tubular applicator, said spindle has an unattached end, and an axial distance from the unattached end of the spindle to said point adjacent said free end of said elongate element is less than said axial length of the tubular applicator.

6. The adaptor of claim 5, wherein the spindle has a length of about 9 inches and said axial distance from the unattached end of the spindle to said point is less than 2 inches.

7. The adaptor of claim 1, wherein said element is made of spring steel.

8. The adaptor of claim 3, wherein said retaining means comprises two elongate elements, and a single member defines both of said elongate elements, said single member including a transverse portion connecting said elongate elements to one another, said transverse portion being secured to said spindle.

9. The adaptor of claim 3, wherein said retaining means comprises two elongate elements, a transverse element connecting said elongate elements to one another, said transverse element being secured to said spindle, and a stop element projecting from the adaptor in a direction transverse to the spindle and transverse to the transverse element.

10. In combination, a spinning device and an adaptor for holding a tubular applicator on the spinning device, the tubular applicator having a bore, the adaptor comprising:

an elongate spindle for receiving the bore of the applicator;

means connected to said spindle for releasably retaining the applicator on the spindle, said retaining means comprising an element and means for resiliently biasing said element toward said spindle, and means for attaching said adaptor to the spinning device.

11. The combination of claim 10, wherein the spinning device comprises a first set of clamping elements, and said means for attaching the adaptor comprises a member in clamping engagement with said clamping elements.

12. The combination of claim 11, wherein the spinning device further comprises a second set of clamping elements, and said adaptor is in clamping engagement with said second set of clamping elements.

13. The combination of claim 11, wherein the adaptor further comprises means for setting a position of the adaptor relative to the spinning device.

14. The combination of claim 11, wherein said position setting means comprises a stop element in engagement with said second set of clamping elements.

15. In combination, a tubular applicator having first and second opposite ends and a bore open at said first end and closed at said second end; and an adaptor for holding the tubular applicator on a spinning device, comprising an elongate spindle for receiving the bore of the applicator, the elongate spindle having an unattached end, the closed end of the bore contacting the closed end of the spindle;

means connected to said spindle for releasably retaining the applicator on the spindle, said retaining means comprising an element and means for resiliently biasing said element toward said spindle; and means for attaching said adaptor to the spinning device, wherein said element is an elongate element having resilience, said means for resiliently biasing comprises the resilience of the material of the elongate element, said elongate element has a free end, a portion of said elongate element distal to said free end is secured relative to said spindle, a guide portion of said elongate element projects away from said spindle at an oblique angle from a point adjacent said free end, and said adaptor is adapted to hold any of a plurality of tubular applicators having various axial lengths, wherein said spindle has a length at least as great as the axial length of the tubular applicator, said spindle has an unattached end, and an axial distance from the unattached end of the spindle to said point adjacent said free end of said elongate element is less than said axial length of the tubular applicator.

16. The combination of claim 15, wherein the tubular applicator has an axial length of 2 to 9 inches.

* * * * *